US011817653B2

(12) United States Patent
Morgan et al.

(10) Patent No.: US 11,817,653 B2
(45) Date of Patent: Nov. 14, 2023

(54) ELECTRICAL CONNECTOR HAVING RESONANCE CONTROL

(71) Applicant: TE Connectivity Services GmbH, Schaffhausen (CH)

(72) Inventors: Chad William Morgan, Carneys Point, NJ (US); Justin Dennis Pickel, Hummelstown, PA (US)

(73) Assignee: TE CONNECTIVITY SOLUTIONS GmbH, Schaffhausen (CH)

( * ) Notice: Subject to any disclaimer, the term of this patent is extended or adjusted under 35 U.S.C. 154(b) by 156 days.

(21) Appl. No.: 17/307,581

(22) Filed: May 4, 2021

(65) Prior Publication Data

US 2022/0360020 A1 Nov. 10, 2022

(51) Int. Cl.

| | |
|---|---|
| ***H01R 4/66*** | (2006.01) |
| ***H01R 13/6471*** | (2011.01) |
| ***H01R 13/6585*** | (2011.01) |
| ***H01R 12/70*** | (2011.01) |
| ***H01R 12/71*** | (2011.01) |

(52) U.S. Cl.

CPC ..... *H01R 13/6471* (2013.01); *H01R 12/7082* (2013.01); *H01R 12/716* (2013.01); *H01R 13/6585* (2013.01)

(58) Field of Classification Search

CPC ..... H01R 13/6471; H01R 13/6585; H01R 12/7082; H01R 12/716

USPC ..... 439/108, 541.5, 710

See application file for complete search history.

(56) References Cited

U.S. PATENT DOCUMENTS

| | | | |
|---|---|---|---|
| 5,236,376 | A | 8/1993 | Cohen |
| 6,168,469 | B1 | 1/2001 | Lu |
| 6,467,165 | B1 | 10/2002 | Glynn |
| 7,131,870 | B2 | 11/2006 | Whiteman, Jr. et al. |
| 7,285,018 | B2 | 10/2007 | Kenny et al. |
| 7,371,117 | B2 | 5/2008 | Gailus |
| 7,513,779 | B2 | 4/2009 | Barr |
| 7,540,781 | B2 | 6/2009 | Kenny et al. |
| 7,887,371 | B2 | 2/2011 | Kenny et al. |
| 8,123,563 | B2 | 2/2012 | Kenny et al. |
| 8,449,330 | B1 | 5/2013 | Schroll et al. |
| 9,431,768 | B1 | 8/2016 | Champion et al. |
| 9,472,900 | B1 | 10/2016 | Phillips et al. |
| 9,490,587 | B1 | 11/2016 | Phillips et al. |
| 9,531,130 | B1 | 12/2016 | Phillips et al. |
| 9,666,990 | B1 | 5/2017 | de Boer et al. |
| 9,666,998 | B1 | 5/2017 | de Boer et al. |

(Continued)

*Primary Examiner* — Khiem M Nguyen

(57) ABSTRACT

A contact module includes a frame assembly having a leadframe and a dielectric frame partially encasing the leadframe. The leadframe includes ground conductors each having a transition portion extending between a mating end configured to be mated to a mating connector and a terminating end configured to be terminated to one of a circuit board or a cable conductor. The dielectric frame includes dielectric material encasing at least a portion of each transition portion. Each mating end extends from the dielectric frame for connection with the mating connector. Each terminating end extends from the dielectric frame for connection with the circuit board or the cable conductor. The contact module includes resistive elements within the dielectric frame. Each resistive element is coupled in series with the transition portion of the corresponding ground conductor.

20 Claims, 6 Drawing Sheets

(56) References Cited

U.S. PATENT DOCUMENTS

| | | | | |
|---|---|---|---|---|
| 9,748,697 | B2 | 8/2017 | Patel et al. | |
| 9,768,557 | B2 | 9/2017 | Phillips et al. | |
| 9,871,325 | B2 | 1/2018 | Patel et al. | |
| 2022/0360020 | A1* | 11/2022 | Morgan ..... | H01R 13/6585 |

* cited by examiner

ELECTRICAL CONNECTOR HAVING RESONANCE CONTROL

BACKGROUND OF THE INVENTION

The subject matter herein relates generally to electrical connectors.

Some electrical connector systems utilize electrical connectors to interconnect various components of the system for data communication. Some known electrical connectors have performance problems, particularly when transmitting at high data rates. For example, the electrical connectors typically utilize differential pair signal conductors to transfer high speed signals. Ground conductors improve signal integrity. However, electrical performance of known electrical connectors, when transmitting the high data rates, is inhibited by noise from cross-talk and return loss. Such issues are more problematic with small pitch high speed data connectors, which are noisy and exhibit higher than desirable return loss due to the close proximity of signal and ground contacts. Energy from ground contacts on either side of the signal pair may be reflected in the space between the ground contacts and such noise results in reduced connector performance and throughput.

A need remains for contact modules for high density, high speed electrical connectors having reliable performance.

BRIEF DESCRIPTION OF THE INVENTION

In one embodiment, a contact module is provided. The contact module includes a frame assembly having a leadframe and a dielectric frame partially encasing the leadframe. The leadframe includes ground conductors. each ground conductor includes a transition portion extending between a mating end and a terminating end. The mating end is configured to be mated to a mating connector. The terminating end is configured to be terminated to one of a circuit board or a cable conductor. The contact module includes the dielectric frame including dielectric material encasing at least a portion of each transition portion. Each mating end extends from the dielectric frame for connection with the mating connector. Each terminating end extends from the dielectric frame for connection with the circuit board or the cable conductor. The contact module includes resistive elements within the dielectric frame. Each resistive element is coupled in series with the transition portion of the corresponding ground conductor.

In another embodiment, a contact module is provided. The contact module includes a frame assembly having a leadframe and a dielectric frame partially encasing the leadframe. The leadframe includes signal conductors and ground conductors. The signal conductors are arranged in pairs. The ground conductors are arranged between the pairs of the signal conductors to electrically separate the pairs of the signal conductors. Each signal conductor includes a signal transition portion extending between a signal mating end and a signal terminating end. The signal mating end is configured to be mated to a mating connector. The signal terminating end is configured to be terminated to one of a circuit board or a corresponding cable conductor. Each ground conductor includes a ground transition portion extending between a ground mating end and a ground terminating end. The ground mating end is configured to be mated to the mating connector. The ground terminating end is configured to be terminated to one of the circuit board or a corresponding cable conductor. The contact module includes a dielectric frame including dielectric material encasing at least a portion of each signal transition portion and at least a portion of each ground transition portion. The contact module includes resistive elements within the dielectric frame. Each resistive element is coupled in series with the ground transition portion of the corresponding ground conductor.

In a further embodiment, an electrical connector is provided. The electrical connector includes a housing having a mating end configured to be mated to a mating connector. The housing has a cavity. The electrical connector includes a contact module stack being received in the cavity. The contact module stack includes a mating end and a terminating end. The contact module stack includes at least one signal contact module including a signal frame assembly having a signal leadframe and a signal dielectric frame partially encasing the signal leadframe. The signal leadframe includes signal conductors each including a signal transition portion extending between a signal mating end and a signal terminating end. The signal mating end is configured to be mated to the mating connector. The signal terminating end is configured to be terminated to one of a circuit board or a corresponding cable conductor. At least one ground contact module includes a ground frame assembly having a ground leadframe and a ground dielectric frame partially encasing the ground leadframe, the ground leadframe including ground conductors each including a ground transition portion extending between a ground mating end and a ground terminating end, the ground mating end configured to be mated to the mating connector, the ground terminating end configured to be terminated to one of the circuit board or a corresponding cable conductor, the ground frame assembly including resistive elements within the ground dielectric frame. Each resistive element coupled in series with the ground transition portion of the corresponding ground conductor. The at least one signal contact module and the at least one ground contact module are arranged in the contact module stack such that the ground conductors and the signal conductors are parallel with each other and aligned with each other between the mating end and the terminating end of the contact module stack.

DETAILED DESCRIPTION OF THE INVENTION

Figure 1:
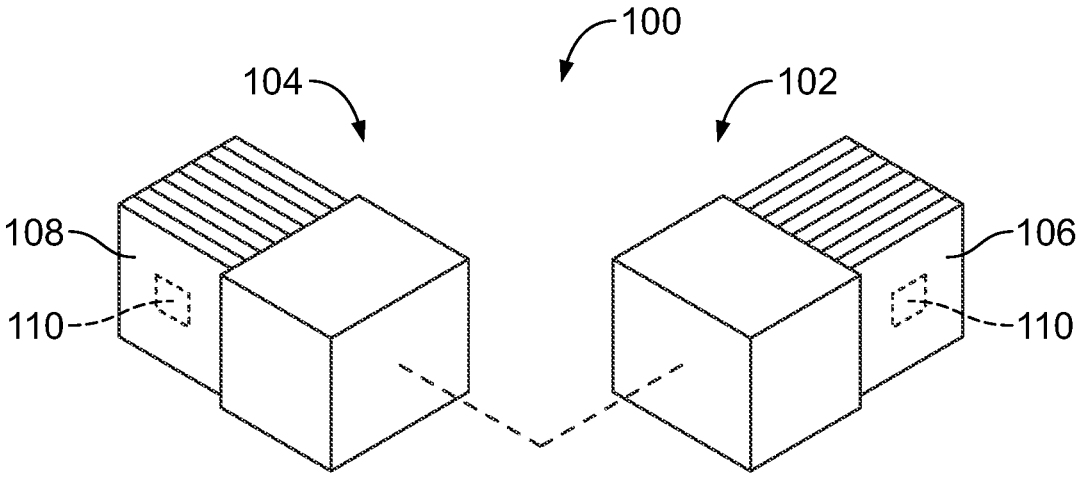
FIG. 1 illustrates an electrical connector including contact modules in accordance with an exemplary embodiment.

FIG. 1 illustrates an electrical connector system 100 in accordance with an exemplary embodiment. The electrical connector system 100 includes a first electrical connector 102 and a second electrical connector 104 that are configured to be directly mated together. The electrical connector system 100 may be disposed on or in an electrical component, such as a server, a computer, a router, or the like. The first electrical connector 102 includes contact modules 106. The second electrical connector 104 includes contact modules 108.

The contact modules 106 and/or the contact modules 108 have resonance control to enhance performance of the electrical connector 100. In an exemplary embodiment, one or more of the contact modules 106, 108 have resonance control to suppress unwanted high-frequency standing wave resonances. In an exemplary embodiment, one or more of the contact modules 106, 108 have ground return paths that are split at one or more locations along the return current paths having series resistive elements 110 placed across the splits in the ground return paths to provide resonance control. Optionally, the contact modules 106, 108 with resonance control provide multiple resistive elements 110 along each of the return current paths. The resistive elements 110 are placed along the lengths of the return current paths to mitigate high-frequency resonances, such as at target frequencies or target frequency ranges. The placements may be controlled to target the frequencies. The resistive elements 110 may be tuned to mitigate high-frequency resonances, such as at the target frequencies or target frequency ranges. The structures of the resistive elements 110 may be designed to target the frequencies, such as by selecting materials of the structures, selecting shapes of the resistive elements 110, and the like to dial the tuning of the resistive elements 110 to the target frequencies. In an exemplary embodiment, the resistive elements 110 are series resistive elements applied to the ground return paths. The resistive elements 110 are part of the contact modules 106, 108 and may be embedded within the structures of the contact modules 106, 108.

Figure 2:
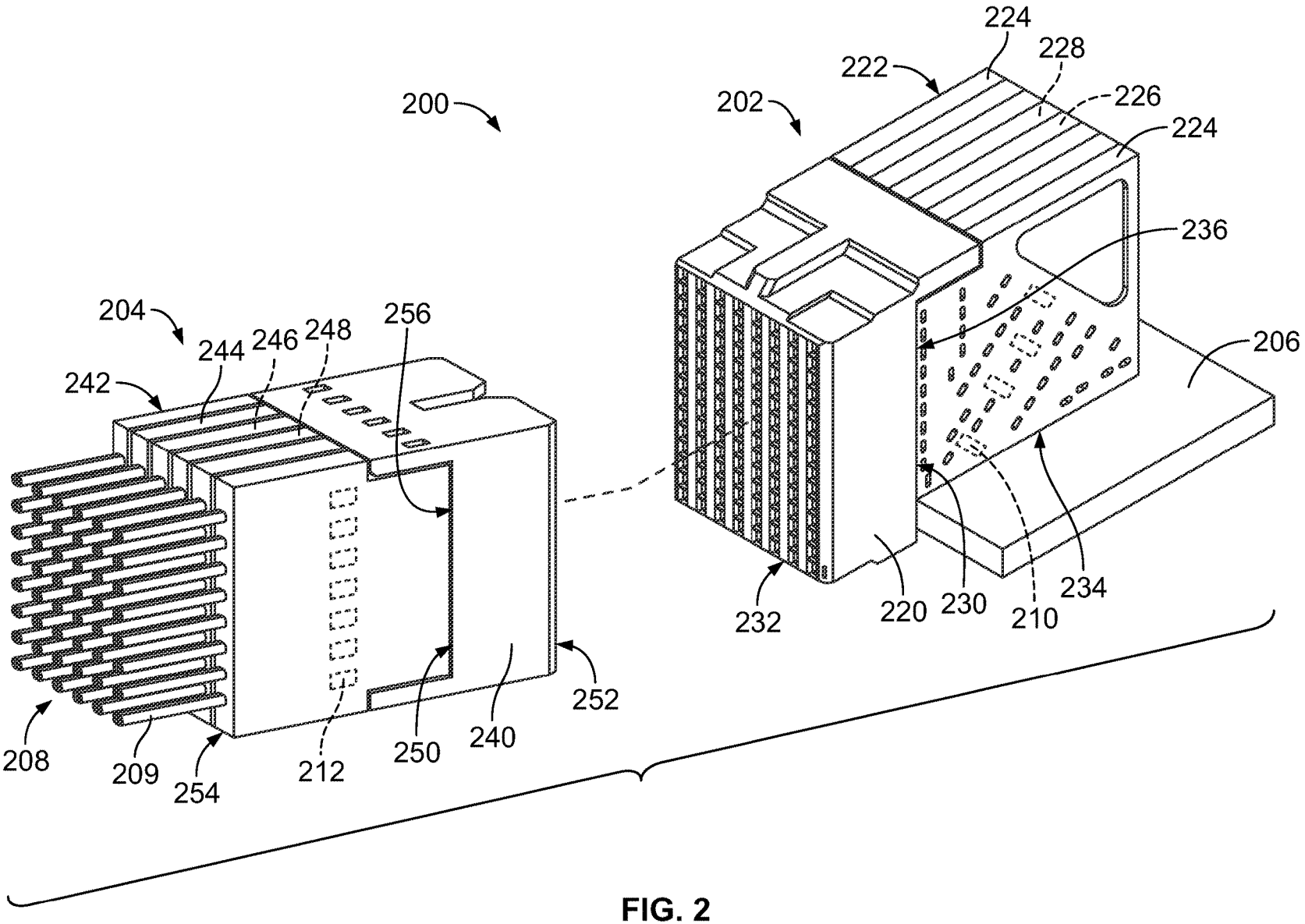
FIG. 2 is a schematic view of an electrical connector system formed in accordance with an embodiment.

FIG. 2 is a schematic view of an electrical connector system 200 formed in accordance with an embodiment. The electrical connector system 200 includes a first electrical connector 202 and a second electrical connector 204 that are configured to be directly mated together. The electrical connector system 200 may be disposed on or in an electrical component, such as a server, a computer, a router, or the like.

In an exemplary embodiment, the first electrical connector 202 is electrically connected to a circuit board 206 and the second electrical connector 204 is electrically connected to a cable assembly 208, which may include a plurality of cables 209 terminated to the second electrical connector 204. The cables 209 may be coaxial cables, twin-axial cables, ribbon cables, flex circuits, or other types of cables 209. The first and second electrical connectors 202, 204 are utilized to provide a signal transmission path to electrically connect the circuit board 206 and the cable assembly 208 to one another at a separable mating interface. In an alternative embodiment, both electrical connectors 202, 204 may be mounted to corresponding circuit boards. In other alternative embodiments, both electrical connectors 202, 204 may be terminated to corresponding cable assemblies.

The first electrical connector 202 includes a housing 220 holding a contact module stack 222 including a plurality of contact modules 224. The contact modules 224 may be wafers or chicklets. In various embodiments, the contact modules 224 are overmolded leadframes. Optionally, the contact modules 224 may include both signal contacts and ground contacts. For example, the signal contacts may be arranged in pairs (for example, arranged in differential pairs) and the ground contacts may be arranged between the pairs of signal contacts to provide shielding between the pairs of signal contacts. For example, the contacts may be arranged in a ground-signal-signal-ground arrangement with pairs of the signal contacts flanked by the ground contacts. Optionally, the contact modules 224 may be high-speed contact modules transmitting high speed data signals. Optionally, at least some of the contact modules 224 may be configured to transmit lower speed signals, such as control signals.

In alternative embodiments, the contact modules 224 may include designated signal contact modules 226 including only signal contacts and designated ground contact modules 228 including only ground contacts. In an exemplary embodiment, the signal and ground contact modules 226, 228 are arranged in a ground-signal-signal-ground arrangement with pairs of signal contact modules 226 flanked by ground contact modules 228. The ground contact modules 228 provide shielding for the signal contact modules 226.

One or more of the contact modules 224 (for example, the ground contact modules 228) employ resonance control to enhance performance of the electrical connector 202. In an exemplary embodiment, one or more of the contact modules 224 have resonance control to suppress unwanted high-frequency standing wave resonances. In an exemplary embodiment, one or more of the contact modules 224 have ground return paths that are split at one or more locations along the return current paths having series resistive elements 210 placed across the splits in the ground return paths to provide resonance control. Optionally, the contact modules 224 with resonance control provide multiple resistive elements 210 along each of the return current paths. The resistive elements 210 are placed along the lengths of the return current paths to mitigate high-frequency resonances, such as at target frequencies or target frequency ranges. The placements may be controlled to target the frequencies. The resistive elements 210 may be tuned to mitigate high-frequency resonances, such as at the target frequencies or target frequency ranges. The structures of the resistive elements 210 may be designed to target the frequencies, such as by selecting materials of the structures, selecting shapes of the resistive elements 210, and the like to dial the tuning of the resistive elements 210 to the target frequencies. In an exemplary embodiment, the resistive elements 210 are series resistive elements applied to the ground return paths. The resistive elements 210 are part of the contact modules 224 and may be embedded within the structures of the contact modules 224, such as within the dielectric bodies of the contact modules 224.

The housing 220 includes multiple walls that define a cavity 230 that receives the contact module stack 222. The housing 220 extends between a mating end 232 and a mounting end 234, which is mounted to the circuit board 206. In the illustrated embodiment, the mounting end 234 is oriented perpendicular to the mating end 232; however, other orientations are possible in alternative embodiments. The resistive elements 210 are provided within the contact modules 224, such as between the mating end 232 and the mounting end 234. The cavity 230 is open at a loading end 236 to receive the contact module stack 222. The housing 220 may be a header housing or a receptacle housing configured for mating with the second electrical connector 204, which may include the other of the header housing or the receptacle housing.

The second electrical connector 204 includes a housing 240 holding a contact module stack 242 including a plurality of contact modules 244. The contact modules 244 may be wafers or chicklets. In various embodiments, the contact modules 244 are overmolded leadframes. The contact modules 244 may be overmolded over the cables 209 in various embodiments to provide strain relief for the cables 209. Optionally, the contact modules 244 may include both signal contacts and ground contacts. For example, the signal contacts may be arranged in pairs (for example, arranged in differential pairs) and the ground contacts may be arranged between the pairs of signal contacts to provide shielding between the pairs of signal contacts. For example, the contacts may be arranged in a ground-signal-signal-ground arrangement with pairs of the signal contacts flanked by the ground contacts. Optionally, the contact modules 244 may be high-speed contact modules transmitting high speed data signals. Optionally, at least some of the contact modules 244 may be configured to transmit lower speed signals, such as control signals.

In alternative embodiments, the contact modules 244 may include designated signal contact modules 246 including only signal contacts and designated ground contact modules 248 including only ground contacts. In an exemplary embodiment, the signal and ground contact modules 246, 248 are arranged in a ground-signal-signal-ground arrangement with pairs of signal contact modules 246 flanked by ground contact modules 248. The ground contact modules 248 provide shielding for the signal contact modules 246.

One or more of the contact modules 244 (for example, the ground contact modules 248) have resonance control to enhance performance of the electrical connector 204. In an exemplary embodiment, one or more of the contact modules 244 have resonance control to suppress unwanted high-frequency standing wave resonances. In an exemplary embodiment, one or more of the contact modules 244 have ground return paths that are split at one or more locations along the return current paths having series resistive elements 212 placed across the splits in the ground return paths to provide resonance control. Optionally, the contact modules 244 with resonance control provide multiple resistive elements 212 along each of the return current paths. The resistive elements 212 are placed along the lengths of the return current paths to mitigate high-frequency resonances, such as at target frequencies or target frequency ranges. The placements may be controlled to target the frequencies. The resistive elements 212 may be tuned to mitigate high-frequency resonances, such as at the target frequencies or target frequency ranges. The structures of the resistive elements 212 may be designed to target the frequencies, such as by selecting materials of the structures, selecting shapes of the resistive elements 212, and the like to dial the tuning of the resistive elements 212 to the target frequencies. In an exemplary embodiment, the resistive elements 212 are series resistive elements applied to the ground return paths. The resistive elements 212 are part of the contact modules 244 and may be embedded within the structures of the contact modules 244, such as within the dielectric bodies of the contact modules 244.

The housing 240 includes multiple walls that define a cavity 250 that receives the contact module stack 242. The housing 240 extends between a mating end 252 and a mounting end 254, which is mounted to the cable assembly 208. The cables 209 extend from the mounting end 254. In the illustrated embodiment, the mounting end 254 is opposite the mating end 252 (for example, at the front and the rear of the housing 240); however, other orientations are possible in alternative embodiments. The resistive elements 212 are provided within the contact modules 244, such as between the mating end 252 and the mounting end 254. The cavity 250 is open at a loading end 256 to receive the contact module stack 242. The housing 240 may be a header housing or a receptacle housing configured for mating with the first electrical connector 202, which may include the other of the header housing or the receptacle housing.

Figure 3:
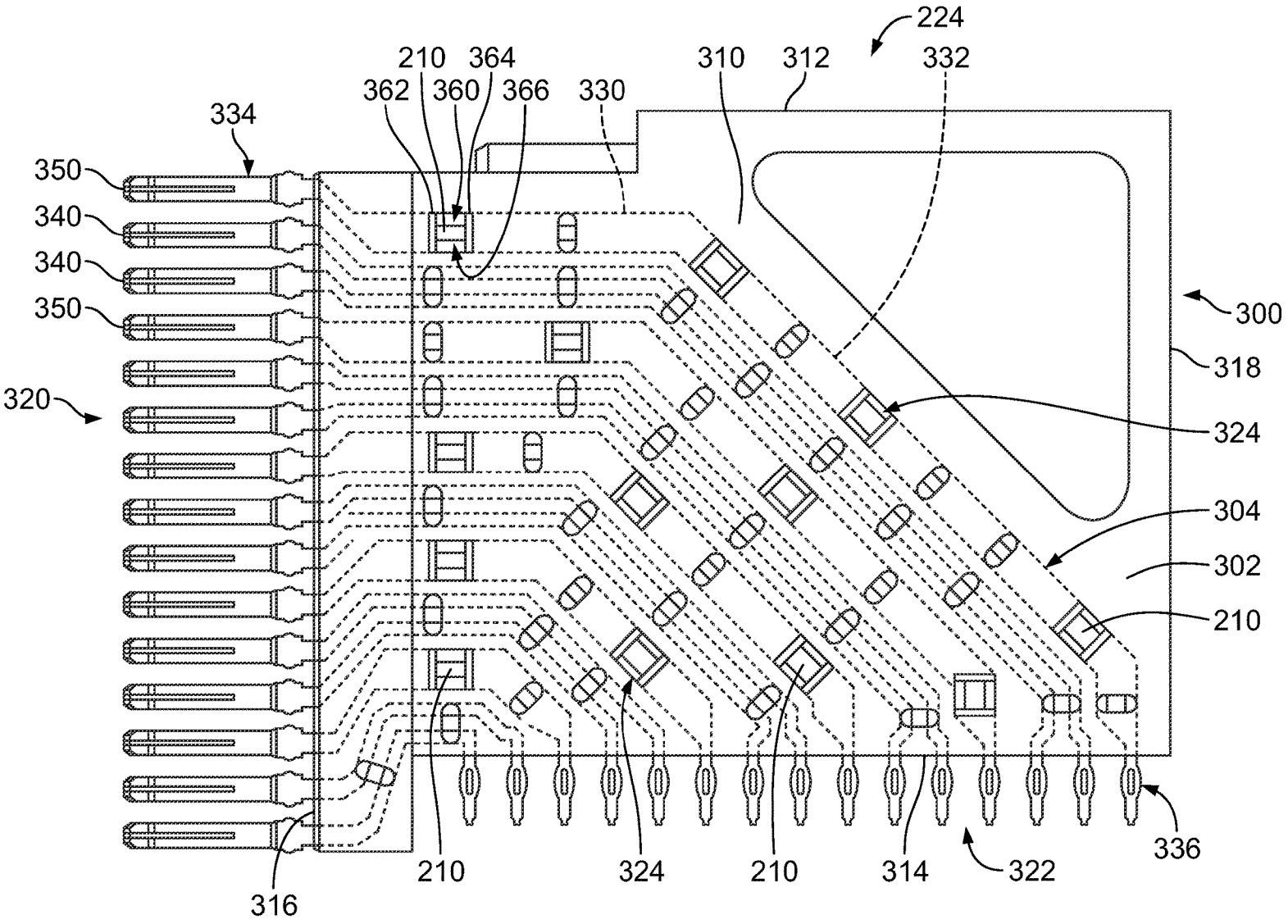
FIG. 3 is a side view of the contact module in accordance with an exemplary embodiment.

FIG. 3 is a side view of the contact module 224 in accordance with an exemplary embodiment. The contact module 224 may be an overmolded leadframe. In the illustrated embodiment, the contact module 224 includes both signal contacts and ground contacts. The resistive elements 210 are coupled to the ground contacts. In alternative embodiments, the contact module 224 may be a ground-only contact module, such as the ground contact module 228 (shown in FIG. 2) having only ground contacts rather than both signal contacts and ground contacts. In such embodiments, the resistive elements 210 may be coupled to each of the conductors in the contact module (for example, because all of the conductors are ground conductors). The contact module 244 (shown in FIG. 2) of the second electrical connector 204 (shown in FIG. 2) may include similar features as the contact module 224 illustrated in FIG. 3; however, the shape of the conductors may be different and the conductors may have different terminating ends for terminating to the cables 209 (shown in FIG. 2) rather than termination to the circuit board 206 (shown in FIG. 2).

In an exemplary embodiment, the contact module 224 includes a frame assembly 300 having a dielectric frame 302 and a leadframe 304. The dielectric frame 302 encases at least a portion of the leadframe 304. The dielectric frame 302 is manufactured from a dielectric material, such as a plastic material, which surrounds the leadframe 304. The dielectric frame 302 may be overmolded around the leadframe 304 in various embodiments. Portions of the leadframe 304 may extend from edges of the dielectric frame 302, such as for mating with the second electrical connector 204 or for termination to the circuit board 206.

The dielectric frame 302 includes sides 310 extending between a top 312, a bottom 314, a front 316, and a rear 318. In the illustrated embodiment, the front 316 defines a mating end 320 and the bottom defines a mounting end 322 of the dielectric frame 302. Other orientations are possible in alternative embodiments, such as having the mounting end at the bottom 314 or having the mating end at the top 312. The dielectric frame 302 may include windows 324 formed in the side(s) 310. The windows 324 expose the leadframe 304. The windows 324 may be formed during the forming process, such as during the overmolding process. For example, the windows 324 may be formed by pinch-points, which are used to hold the leadframe 304 during the overmolding process. The windows 324 may extend partially through the dielectric frame 302 or may extend entirely through the dielectric frame 302.

The leadframe 304 includes leads or conductors 330, which may be initially held together by a frame or carrier, which is removed after the overmolding process when the conductors 330 are held by the dielectric frame 302. Each conductor 330 includes a transition portion 332 extending between a mating end 334 and a terminating end 336. The transition portion 332 may have one or more bends (for example, to form right-angle conductors) to transition between the mating end 320 and the mounting end 322. In an exemplary embodiment, the transition portion 332 is encased in the dielectric frame 302. For example, the dielectric frame 302 may be overmolded over the transition portion 332 to secure and retain the transition portion 332. The mating end 334 extends from the mating end 320 of the dielectric frame 302 (for example, forward from the mating end 320). The mating end 334 is configured to be mated with the second electrical connector 204. For example, the mating end 334 may include a beam, a pin, a socket or another mating interface. The terminating end 336 extends from the mounting end 322 of the dielectric frame 302 (for example, downward from the mounting end 322). The terminating end 336 is configured to be coupled to the circuit board 206. For example, the terminating end 336 may include a solder tail, a press fit pin, or another structure for electrically connecting to the circuit board 206. In cable applications, the terminating end 336 may include a solder pad, a crimp barrel, an insulation displacement contact or another structure for termination to a cable.

In an exemplary embodiment, the conductors 330 include signal conductors 340 and ground conductors 350. The signal conductors 340 are arranged in pairs (for example, arranged in differential pairs) and the ground conductors 350 are arranged between the pairs of signal conductors 340 to provide shielding between the pairs of signal conductors 340. For example, the conductors 330 may be arranged in a ground-signal-signal-ground arrangement with pairs of the signal conductors 340 flanked by the ground conductors 350.

In an exemplary embodiment, the resistive elements 210 are coupled to the ground conductors 350, such as along the transition portions 332. The signal conductors 340 do not include any resistive elements 210. The resistive elements 210 provide series ground breaks along the ground paths of the ground conductors 350. Optionally, each ground conductor 350 may include a single resistive element 210. Alternatively, each ground conductor 350 may include multiple resistive elements 210 periodically along the length of the ground conductor 350.

In an exemplary embodiment, the ground conductor 350 includes a break or discontinuity 360 at each resistance location. The discontinuity 360 may be formed by physically removing a segment of the ground conductor 350. For example, the windows 324 are provided at designated areas along the length of the ground conductor 350. The windows 324 expose portions of the ground conductor 350. A tool may be used to punch or cut the ground conductor 350 exposed within the window 324 to remove the segment of the ground conductor 350 to form the discontinuity 360. In other embodiments, the ground conductor 350 may be laser cut to form the discontinuity 360. In other embodiments, the discontinuity may be formed prior to overmolding, such as by a stamping process when the leadframe 304 is formed. The ground conductor 350 includes a first segment 362 upstream of the discontinuity 360 and a second segment 364 downstream of the discontinuity 360. A gap 366 is defined between the first and second segments 362, 364. The first segment 362 and/or the second segment 364 may be exposed within the window 324 after the discontinuity 360 is formed, such as for electrical connection with the resistive element 210.

The resistive element 210 forms a resistive path within the ground return path defined by the ground conductor 350. The resistive element 210 may be a discrete component, such as a resistor, which is electrically connected to the ground conductor 350 at the resistance location. The resistor spans across the gap 366 and may be soldered, laser welded, ultrasonically welded, or otherwise mechanically and electrically connected to the first and second segments 362, 364. The resistor may be made from a mixture of finely powdered carbon and an insulating material, such as a ceramic material, with a resin holding the mixture together and leads extending from the ends of the resistor. In various embodiments, the resistor is an axial resistor having the leads extending axially from opposite ends of the resistor for termination to the first and second segments 362, 364. In other various embodiments, the resistor is a metal film resistor or a foil resistor.

In alternative embodiments, the resistive element 210 may be a resistive patch applied to the ground conductor 350. In various embodiments, the resistive element 210 may be formed in situ within the contact module 224. For example, the resistive element 210 may be printed in place across the gap 366. The resistive element 210 may be a resistive epoxy or a resistive ink that is printed on the contact module 224 across the gap 366. In various embodiments, the dielectric frame 302 may form a backing for printing the resistive element across the gap 366. The resistive element 210 may include a dielectric base material and a resistive filler material embedded in the dielectric base material. For example, the dielectric base material may be epoxy material and the resistive filler material may be carbon and/or graphite or other resistive material embedded in the epoxy material The filler material may be powder or flakes embedded in the dielectric base material. The resistive element 210 may be printed, such as using a jet printer, a dabbing printer, a screen printer or another type of printer. The resistive element 210 may be applied by other processes other than printing in alternative embodiments. The types of materials selected, the ratios of the materials selected, and the like may be selected to control the resistivity of the resistive element 210. The length, width and thickness of the resistive element 210 may affect the resistance of the resistive element 210 and may be controlled to tune the resistive element 210 within the contact module 224.

Figure 4:
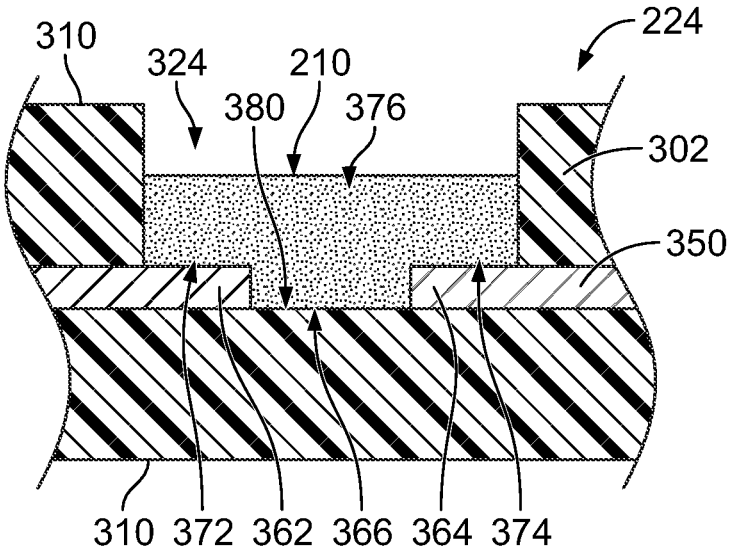
FIG. 4 is a cross-sectional view of a portion of the contact module in accordance with an exemplary embodiment.

FIG. 4 is a cross-sectional view of a portion of the contact module 224 in accordance with an exemplary embodiment. FIG. 4 shows the resistive element 210 within the contact module 224 coupled to the ground conductor 350. The resistive element 210 includes a first mating end 372 coupled to the first segment 362 and a second mating end 374 coupled to the second segment 364. A resistive portion 376 is provided between the first and second mating ends 372, 374. The resistive portion 376 is formed from the dielectric base material and the filler material. The resistance of the resistive element 210 is based on the selected materials, the relative amounts of the materials, the size and shape of the resistive element 210, and the like. Changing materials and/or the structure of the resistive element 210 changes the resistance, which affects the resonance frequency control provided by the resistive element 210.

In an exemplary embodiment, the ground conductor 350 is exposed within the window 324 for termination of the resistive element 210 to the ground conductor 350. For example, the first and second segments 362, 364 of the ground conductor 350 are both exposed within the window 324. The resistive element 210 is printed directly onto the first and second segments 362, 364. The dielectric frame 302 forms a bridge 380 behind the ground conductor 350, which defines a surface for printing the resistive element 210 across the gap 366 between the first and second segments 362, 364. In an exemplary embodiment, the resistive element 210 at least partially fills the window 324. For example, the ink or epoxy is printed directly into the contact module 224. Optionally, the material comprising the resistive element 210 may fully fill the window so as to be flush with the side 310 of the dielectric frame 302 or may be recessed inside the dielectric frame 302 such that the resistive element 210 does not increase the width of the contact module 224.

Figure 5:
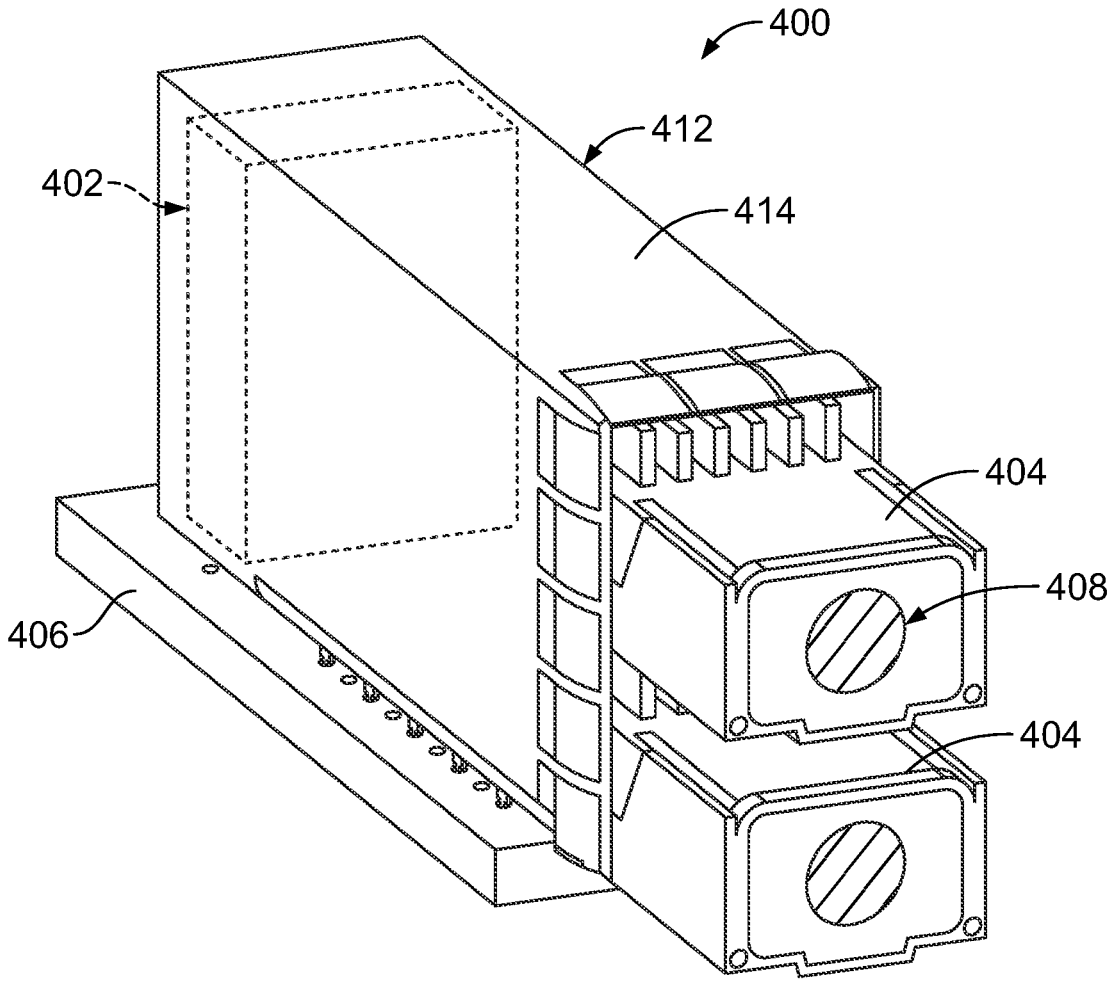
FIG. 5 is a schematic view of an electrical connector system formed in accordance with an embodiment.

FIG. 5 is a schematic view of an electrical connector system 400 formed in accordance with an embodiment. The electrical connector system 400 includes a first electrical connector 402 and a second electrical connector 404 that are configured to be directly mated together. The electrical connector system 400 may be disposed on or in an electrical component, such as a server, a computer, a router, or the like.

In an exemplary embodiment, the first electrical connector 402 is electrically connected to a circuit board 406 and the second electrical connector 404 is electrically connected to a cable assembly 408. The first electrical connector 402 may be a communication connector of a receptacle assembly 412. For example, in the illustrated embodiment, the first electrical connector 402 is a card edge connector having one or more card slots for receiving circuit cards. The second electrical connector 404 is a pluggable module, such as an I/O module, having a circuit card configured to be plugged into the card slot of the first electrical connector 402. In an exemplary embodiment, the receptacle assembly 412 includes a receptacle cage 414 having a module channel that receives the second electrical connector 404 (for example, the pluggable module). The first and second electrical connectors 402, 404 are utilized to provide a signal transmission path to electrically connect the circuit board 406 and the pluggable module at a separable mating interface.

Figure 6:
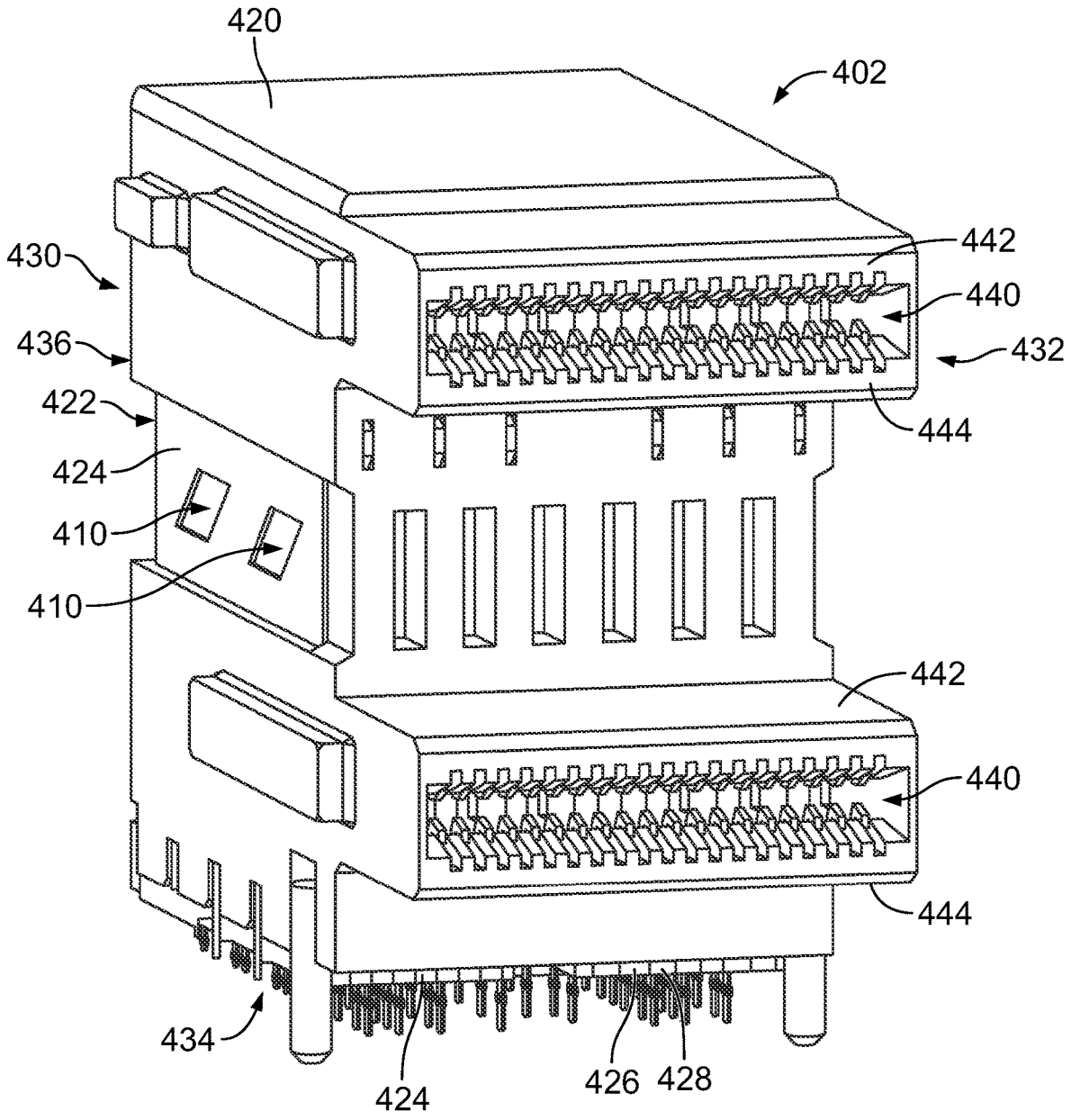
FIG. 6 is a perspective view of the first electrical connector in accordance with an exemplary embodiment.

FIG. 6 is a perspective view of the first electrical connector 402 in accordance with an exemplary embodiment. The first electrical connector 402 includes a housing 420 holding a contact module stack 422 including a plurality of contact modules 424. The contact modules 424 may be wafers or chicklets. In various embodiments, the contact modules 424 are overmolded leadframes. Optionally, the contact modules 424 may include both signal contacts and ground contacts. In the illustrated embodiment, the contact modules 424 includes signal contact modules 426 including only signal contacts and ground contact modules 428 including only ground contacts. In an exemplary embodiment, the signal and ground contact modules 426, 428 are arranged in a ground-signal-signal-ground arrangement with pairs of signal contact modules 426 flanked by ground contact modules 428. The ground contact modules 428 provide shielding for the signal contact modules 426.

In an exemplary embodiment, the ground contact modules 428 have resonance control to enhance performance of the electrical connector 402. In an exemplary embodiment, one or more of the ground contact modules 428 have resonance control to suppress unwanted high-frequency standing wave resonances. In an exemplary embodiment, one or more of the ground contact modules 428 have ground return paths that are split at one or more locations along the return current paths having series resistive elements 410 placed across the splits in the ground return paths to provide resonance control. Optionally, the ground contact modules 428 with resonance control provide multiple resistive elements 410 along each of the return current paths. The resistive elements 410 are placed along the lengths of the return current paths to mitigate high-frequency resonances, such as at target frequencies or target frequency ranges. The placements may be controlled to target the frequencies. The resistive elements 410 may be tuned to mitigate high-frequency resonances, such as at the target frequencies or target frequency ranges. The structures of the resistive elements 410 may be designed to target the frequencies, such as by selecting materials of the structures, selecting shapes of the resistive elements 410, and the like to tune the resistive elements 410 to the target frequencies. In an exemplary embodiment, the resistive elements 410 are series resistive elements applied to the ground return paths. The resistive elements 410 are part of the ground contact modules 428 and may be embedded within the structures of the ground contact modules 428, such as within the dielectric bodies of the ground contact modules 428.

The housing 420 includes multiple walls that define a cavity 430 that receives the contact module stack 422. The housing 420 extends between a mating end 432 and a mounting end 434, which is mounted to the circuit board 406. In the illustrated embodiment, the mounting end 434 is oriented perpendicular to the mating end 432; however, other orientations are possible in alternative embodiments. The resistive elements 410 are provided within the ground contact modules 428, such as between the mating end 432 and the mounting end 434. The cavity 430 is open at a loading end 436 to receive the contact module stack 422. In an exemplary embodiment, the housing 420 includes one or more card slots 440 at the mating end 432. The card slot 440 receives the circuit card of the second electrical connector 404. The housing 420 includes an upper wall 442 above the card slot 440 and a lower wall 442 below the card slot 440. The signal and ground contacts are arranged in an upper row along the upper wall 442 and a lower row along the lower wall 444 to mate with contact pads on an upper surface and a lower surface of the circuit card.

Figure 7:
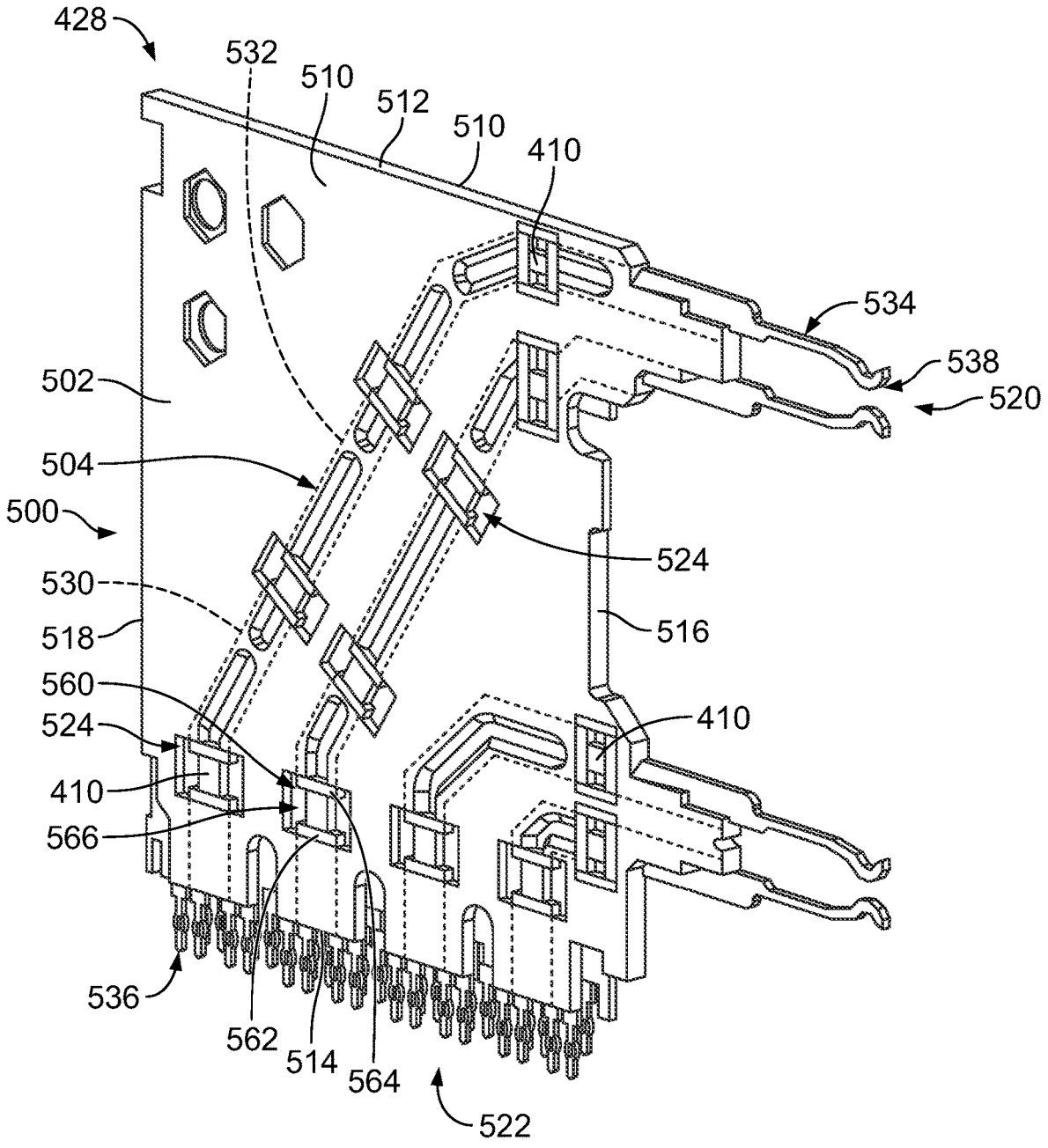
FIG. 7 is a perspective view of the ground contact module in accordance with an exemplary embodiment.

FIG. 7 is a perspective view of the ground contact module 428 in accordance with an exemplary embodiment. The signal contact module 426 (shown in FIG. 6) may include a similar structure as the ground contact module 428, without the resistive elements 410. The ground contact module 428 may be an overmolded leadframe. In an exemplary embodiment, the ground contact module 428 includes a frame assembly 500 having a dielectric frame 502 and a leadframe 504. The dielectric frame 502 encases at least a portion of the leadframe 504. The dielectric frame 502 is manufactured from a dielectric material, such as a plastic material, which surrounds the leadframe 504. The dielectric frame 502 may be overmolded around the leadframe 504 in various embodiments. Portions of the leadframe 504 may extend from edges of the dielectric frame 502, such as for mating with the second electrical connector 404 or for termination to the circuit board 406.

The dielectric frame 502 includes sides 510 extending between a top 512, a bottom 514, a front 516, and a rear 518. In the illustrated embodiment, the front 516 defines a mating end 520 and the bottom defines a mounting end 522 of the dielectric frame 502. Other orientations are possible in alternative embodiments, such as having the mounting end at the bottom 514 or having the mating end at the top 512. The dielectric frame 502 may include windows 524 formed in the side(s) 510. The windows 524 expose the leadframe 504.

The leadframe 504 includes leads or conductors that define ground conductors 530, which may be initially held together by a frame or carrier, which is removed after the overmolding process when the ground conductors 530 are held by the dielectric frame 502. Each ground conductor 530 includes a transition portion 532 extending between a mating end 534 and a terminating end 536. The transition portion 532 may have one or more bends (for example, to form right-angle conductors) to transition between the mating end 520 and the mounting end 522. In an exemplary embodiment, the transition portion 532 is encased in the dielectric frame 502. For example, the dielectric frame 502 may be overmolded over the transition portion 532 to secure and retain the transition portion 532. The mating end 534 extends from the mating end 520 of the dielectric frame 502 (for example, forward from the mating end 520). The mating end 534 is configured to be mated with the circuit card of the second electrical connector 404. For example, the mating end 534 may include a beam, such as a spring beam, defining a separable mating interface. The terminating end 536 extends from the mounting end 522 of the dielectric frame 502 (for example, downward from the mounting end 522). The terminating end 536 is configured to be coupled to the circuit board 406. For example, the terminating end 536 may include a solder tail, a press fit pin, or another structure for electrically connecting to the circuit board 406. In cable applications, the terminating end 536 may include a solder pad, a crimp barrel, an insulation displacement contact or another structure for termination to a cable. The ground conductors 530 may be arranged in pairs that face each other across a gap 538, which receives the circuit card. The pair of ground conductors 530 are configured to mate with upper and lower surfaces of the circuit card.

In an exemplary embodiment, the resistive elements 410 are coupled to the ground conductors 530 along the transition portions 532. The resistive elements 410 provide series ground breaks along the ground paths of the ground conductors 530. Optionally, each ground conductor 530 may include a single resistive element 410. Alternatively, each ground conductor 530 may include multiple resistive elements 410 periodically along the length of the ground conductor 530.

In an exemplary embodiment, the ground conductor 530 includes a break or discontinuity 560 at each resistance location. The discontinuity 560 may be formed by physically removing a segment of the ground conductor 530. For example, the windows 524 are provided at designated areas along the length of the ground conductor 530. The windows 524 expose portions of the ground conductor 530. The ground conductor 530 includes a first segment 562 upstream of the discontinuity 560 and a second segment 564 downstream of the discontinuity 560. A gap 566 is defined between the first and second segments 562, 564. The first segment 562 and/or the second segment 564 may be exposed within the window 524 after the discontinuity 560 is formed, such as for electrical connection with the resistive element 410.

The resistive element 410 forms a resistive path within the ground return path defined by the ground conductor 530. The resistive element 410 may be a discrete component, such as a resistor, which is electrically connected to the ground conductor 530 at the resistance location. The resistor spans across the gap 566 and may be soldered, laser welded, ultrasonically welded, or otherwise mechanically and electrically connected to the first and second segments 562, 564. In alternative embodiments, the resistive element 410 may be a resistive patch applied to the ground conductor 530. In various embodiments, the resistive element 410 may be formed in situ within the ground contact module 428. For example, the resistive element 410 may be printed in place across the gap 566. The resistive element 410 may be a resistive epoxy or a resistive ink that is printed on the ground contact module 428 across the gap 566.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A contact module comprising:

a frame assembly having a leadframe and a dielectric frame partially encasing the leadframe;

the leadframe including ground conductors, each ground conductor including a transition portion extending between a mating end and a terminating end, the mating end configured to be mated to a mating connector, the terminating end configured to be terminated to one of a circuit board or a cable conductor;

the dielectric frame including dielectric material encasing at least a portion of each transition portion, each mating end extending from the dielectric frame for connection with the mating connector, each terminating end extending from the dielectric frame for connection with the circuit board or the cable conductor; and resistive elements within the dielectric frame, each resistive element coupled in series with the transition portion of the corresponding ground conductor.

2. The contact module of claim 1, wherein the resistive elements are series resistive elements.

3. The contact module of claim 1, wherein the resistive elements are enclosed within the dielectric frame.

4. The contact module of claim 1, wherein each transition portion includes a plurality of the resistive elements in series along a length of the transition portion.

5. The contact module of claim 1, wherein each transition portion is discontinuous defined by discontinuities along a length of the transition portion, the resistive elements spanning the discontinuities.

6. The contact module of claim 1, wherein each transition portion is discontinuous including a gap between a first segment and a second segment, the resistive element spanning the corresponding gap between the first segment and the second segment.

7. The contact module of claim 6, wherein the dielectric frame includes a window exposing the first segment and the second segment, the dielectric frame including a bridge across the window, the resistive element being applied to the bridge across the gap between the first segment and the second segment.

8. The contact module of claim 1, wherein the resistive element is a resistor having a first lead, a second lead, and a resistor portion between the first lead and the second lead, the first lead being soldered to a first segment of the corresponding transition portion, the second lead being soldered to a second segment of the corresponding transition portion.

9. The contact module of claim 1, wherein the resistive element is a resistive patch being printed on the transition portion between a first segment and a second segment of the corresponding transition portion.

10. The contact module of claim 9, wherein the resistive patch includes a dielectric base material and resistive filler material embedded in the dielectric base material.

11. The contact module of claim 9, wherein the resistive patch is one of a resistive ink or a resistive epoxy.

12. The contact module of claim 1, wherein the leadframe includes signal conductors arranged in pairs, the ground conductors arranged between the pairs of the signal conductors to electrically separate the pairs of the signal conductors, each signal conductor including a signal transition portion extending between a signal mating end and a signal terminating end, the signal mating end configured to be mated to the mating connector, the signal terminating end configured to be terminated to one of the circuit board or a corresponding cable conductor.

13. The contact module of claim 1, wherein the contact module is a ground contact module, the ground contact module configured to be arranged in a contact module stack in a stacked arrangement adjacent a signal contact module including a signal frame assembly having a signal leadframe and a signal dielectric frame partially encasing the signal leadframe, the signal leadframe including signal conductors each including a signal transition portion extending between a signal mating end and a signal terminating end, the signal mating end configured to be mated to the mating connector, the signal terminating end configured to be terminated to one of the circuit board or a corresponding cable conductor.

14. A contact module comprising:

a frame assembly having a leadframe and a dielectric frame partially encasing the leadframe;

the leadframe including signal conductors and ground conductors, the signal conductors arranged in pairs, the ground conductors arranged between the pairs of the signal conductors to electrically separate the pairs of the signal conductors, each signal conductor including a signal transition portion extending between a signal mating end and a signal terminating end, the signal mating end configured to be mated to a mating connector, the signal terminating end configured to be terminated to one of a circuit board or a corresponding cable conductor, each ground conductor including a ground transition portion extending between a ground mating end and a ground terminating end, the ground mating end configured to be mated to the mating connector, the ground terminating end configured to be terminated to one of the circuit board or a corresponding cable conductor;

the dielectric frame including dielectric material encasing at least a portion of each signal transition portion and at least a portion of each ground transition portion; and resistive elements within the dielectric frame, each resistive element coupled in series with the ground transition portion of the corresponding ground conductor.

15. The contact module of claim 14, wherein each ground transition portion includes a plurality of the resistive elements in series along a length of the ground transition portion.

16. The contact module of claim 14, wherein each ground transition portion is discontinuous including a gap between a first segment and a second segment, the resistive element spanning the corresponding gap between the first segment and the second segment.

17. The contact module of claim 14, wherein the resistive element is a resistive patch being printed on the ground transition portion between a first segment and a second segment of the corresponding ground transition portion, the resistive patch including a dielectric base material and filler material embedded in the dielectric base material.

18. An electrical connector comprising:

a housing having a mating end configured to be mated to a mating connector, the housing having a cavity;

a contact module stack being received in the cavity, the contact module stack including a mating end and a terminating end, the contact module stack comprising:

at least one signal contact module including a signal frame assembly having a signal leadframe and a signal dielectric frame partially encasing the signal leadframe, the signal leadframe including signal conductors each including a signal transition portion extending between a signal mating end and a signal terminating end, the signal mating end configured to be mated to the mating connector, the signal terminating end configured to be terminated to one of a circuit board or a corresponding cable conductor; and at least one ground contact module including a ground frame assembly having a ground leadframe and a ground dielectric frame partially encasing the ground leadframe, the ground leadframe including ground conductors each including a ground transition portion extending between a ground mating end and a ground terminating end, the ground mating end configured to be mated to the mating connector, the ground terminating end configured to be terminated to one of the circuit board or a corresponding cable conductor, the ground frame assembly including resistive elements within the ground dielectric frame, each resistive element coupled in series with the ground transition portion of the corresponding ground conductor;

wherein the at least one signal contact module and the at least one ground contact module are arranged in the contact module stack such that the ground conductors and the signal conductors are parallel each other and aligned with each other between the mating end and the terminating end of the contact module stack.

19. The electrical connector of claim 18, wherein each ground transition portion includes a plurality of the resistive elements in series along a length of the ground transition portion.

20. The electrical connector of claim 18, wherein each ground transition portion is discontinuous including a gap between a first segment and a second segment, the resistive element being a resistive patch spanning the corresponding gap between the first segment and the second segment of the corresponding ground transition portion, the resistive patch including a dielectric base material and resistive filler material embedded in the dielectric base material.

* * * * *